US009990871B1

(12) United States Patent
Marques

(10) Patent No.: US 9,990,871 B1
(45) Date of Patent: Jun. 5, 2018

(54) CHEERING BANNER

(71) Applicant: Robert J. Marques, Richmond, KY (US)

(72) Inventor: Robert J. Marques, Richmond, KY (US)

( * ) Notice: Subject to any disclaimer, the term of this patent is extended or adjusted under 35 U.S.C. 154(b) by 0 days. days.

(21) Appl. No.: 15/367,377

(22) Filed: Dec. 2, 2016

(51) Int. Cl.

| | |
|---|---|
| ***G09F 17/00*** | (2006.01) |
| ***G09F 13/22*** | (2006.01) |
| ***F21V 33/00*** | (2006.01) |
| ***F21V 21/40*** | (2006.01) |
| ***F21V 23/04*** | (2006.01) |
| *F21Y 115/10* | (2016.01) |

(52) U.S. Cl.
CPC ..... *G09F 17/00* (2013.01); *F21V 21/40* (2013.01); *F21V 23/04* (2013.01); *F21V 33/008* (2013.01); *G09F 13/22* (2013.01); *F21Y 2115/10* (2016.08); *G09F 2013/222* (2013.01)

(58) Field of Classification Search
CPC ..... F21V 23/04; F21V 33/008; F21V 21/40; F21V 23/005; F21V 33/0008; G09F 2013/222; G09F 2013/225; G09F 17/00; G09F 17/033; G09F 17/005; G09F 17/0075; G09F 2017/0075; F21W 2121/00; F21Y 2115/10; F21Y 2115/22
See application file for complete search history.

(56) References Cited

U.S. PATENT DOCUMENTS

| | | | | |
|---|---|---|---|---|
| 5,113,325 | A * | 5/1992 | Eisenbraun | A41D 27/085 362/103 |
| 6,455,767 | B1 * | 9/2002 | Muller | F21S 9/037 116/173 |
| 6,783,259 | B1 * | 8/2004 | Macedonio | G09F 13/04 362/234 |
| 7,192,168 | B2 * | 3/2007 | Day | G09F 13/22 362/249.03 |
| 8,007,120 | B2 * | 8/2011 | Foley | B60Q 7/02 362/103 |
| 8,215,807 | B1 * | 7/2012 | Brunesti | G09F 17/00 362/431 |
| 2006/0023446 | A1 * | 2/2006 | Racoosin | G09F 17/00 362/227 |
| 2013/0250559 | A1 * | 9/2013 | Hawkins | F21V 33/008 362/183 |

FOREIGN PATENT DOCUMENTS

JP 2009282384 A * 12/2009

* cited by examiner

*Primary Examiner* — Hargobind S Sawhney
(74) *Attorney, Agent, or Firm* — William G. Sykes

(57) ABSTRACT

A banner for displaying while cheering at an event venue. The banner comprises a flexible woven fabric panel bearing indicia related to a partisan of an event taking place at the event venue, a reinforced opening and an illumination source. A handle having an enlarged head penetrates the opening and is retained by a friction fitted washer slipped over the handle. The opening is at one corner of the panel and the illumination source is a light emitting diode with battery and switch all contained in a compartment at another corner.

15 Claims, 1 Drawing Sheet

CHEERING BANNER

FIELD OF THE DISCLOSURE

The present disclosure relates to signs and banners, and more particularly to a banner wielded by hand.

BACKGROUND

Participants at sports events and other events attended by relatively large crowds frequently desire to display signs of identification with a sports team or other featured participant of the event. This may take the form of hand held banners bearing indicia such as mascots, logos, and team name abbreviations.

A hand held banner may be difficult to display to advantage, due to flaccidity of the constituent material. There remains room in the art for flexible banners which are conducive to being wielded and displayed to advantage.

SUMMARY

The disclosed concepts address the above stated situation by providing a hand held banner particularly adapted to being waved and otherwise wielded at large gatherings. Notably, the banner, made from. a flexible fabric, includes a rigid handle removable from the fabric, and an illumination source.

It is an object to provide improved elements and arrangements thereof by apparatus for the purposes described which is inexpensive, dependable, and fully effective in accomplishing its intended purposes.

These and other objects will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
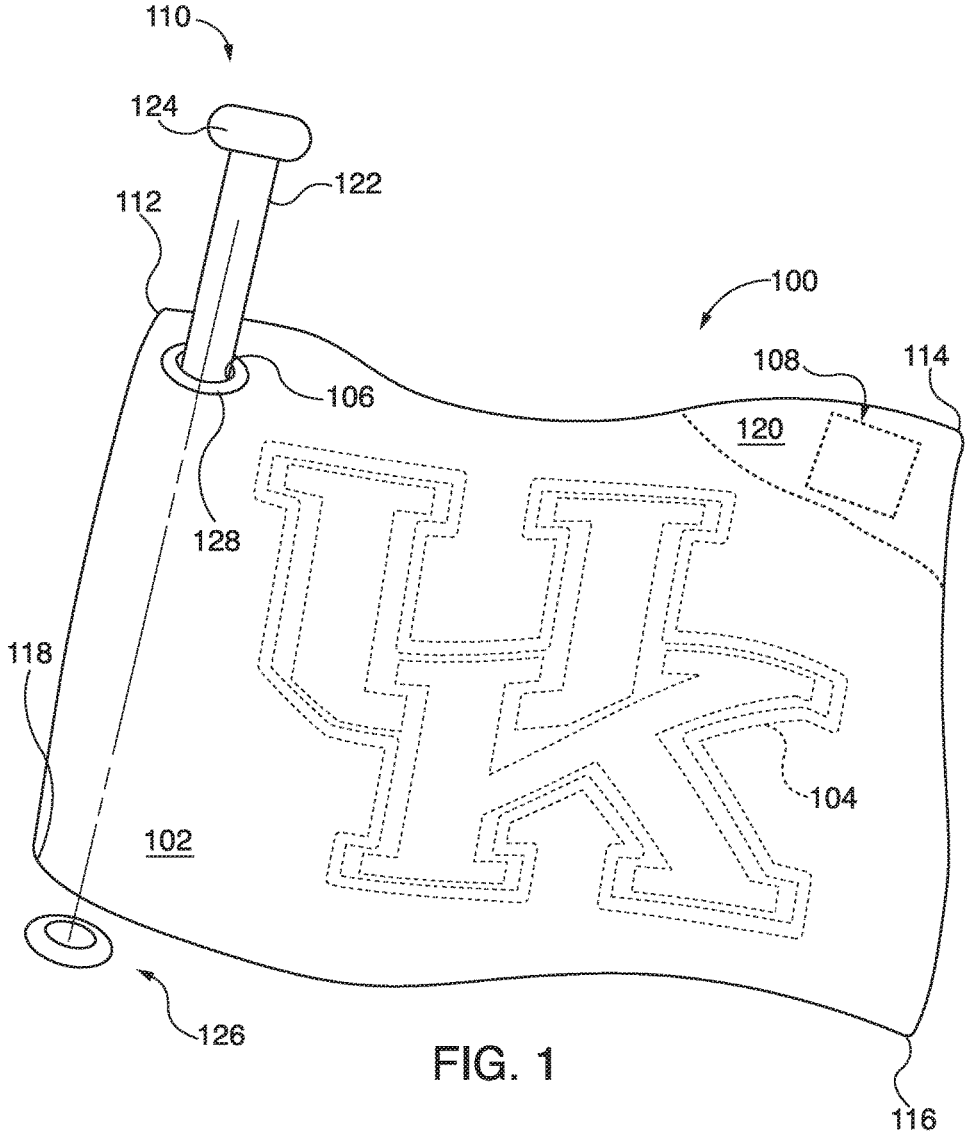
FIG. 1 is a perspective view of a banner, according to at least one aspect of the disclosure.

Referring first to FIG. 1, according to at least one aspect of the disclosure, there is shown a banner 100 for displaying while cheering at an event venue (not shown). Banner 100 may comprise a flexible panel 102 bearing indicia 104 related to a partisan of an event taking place at the event venue. Flexible panel 102 includes an opening 106 and an illumination source which may be an integral part of an inclusion 108 integrated into flexible panel 102. A handle 110 is engageable with flexible panel 102 by penetrating opening 106 of flexible panel 102.

Flexible panel 102 is polygonal and includes corners 112, 114, 116, 118 between adjacent sides. Opening 106 is proximate one of the corners (e.g., corner 112) of flexible panel 102.

The inclusion 108 may comprise a wafer of synthetic material serving both as structural support for the illumination source and associated electrical components, and also as a weight enabling a person to swing banner 100 by shaft 122 while causing fabric panel 102 to be spread flat due to inertial or centrifugal forces enhanced by weight or mass of inclusion 108. To the latter end, inclusion 108 is located at an upper corner 114 of fabric panel 102 other than first upper corner 112. The synthetic material of the wafer may be silicone rubber for example, of thickness and mass sufficient to cause fabric panel 102 to spread when banner 100 is swung.

Flexible panel 102 may include a compartment 120, and the illumination source may be contained within compartment 120. Compartment 120 may be stitched closed. The illumination source may be permanently retained within compartment 120. Compartment 120 may be at a corner (e.g., corner 114) of flexible panel 102 other than that including opening 106 of flexible panel 102.

Handle 110 may comprise a shaft 122 terminating in an enlarged head 124, and a washer 126 slidably engaging shaft 122 by friction such that washer 126 can be slid over shaft 122 after shaft 122 has been passed through opening 106 of flexible panel 102, thereby entrapping flexible panel 102 between enlarged head 124 and washer 126.

Flexible panel 102 may be fabricated from a woven fabric. Hole 106 of flexible panel 102 may comprise a reinforced border. The reinforced border may comprise a metal or plastic eyelet 128, may comprise stitching (not shown), or may take any other suitable form.

Figure 2:
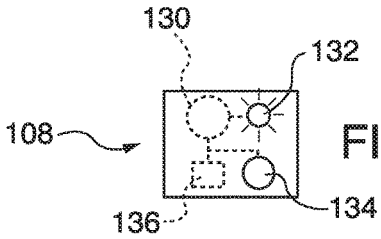
FIG. 2 is a plan view of an illumination source entrapped within the banner of FIG. 1.

Referring also to FIG. 2, the illumination source may be a unitary device combining a battery 130, a light emitting element 132, and a switch 134 controlling light emitting element 132. Switch 134 may protrude from a housing of the illumination source, and be operable by pressure from squeezing. Light emitting element 132 may comprise a light emitting diode.

The illumination source may include a controller 36 controlling timing of light emitting element 132 after switch 134 has been operated. Controller 136 may comprise a microprocessor causing light emitting element 132 to flash or to remain on constantly after switch 134 has been operated, and to extinguish light emitting element 132 when switch 134 is operated a subsequent time.

In use, with handle 110 fully inserted through hole 106, and with washer 126 clamping flexible panel 102 against head 124, the user may grasp handle 110 and swing fabric panel 102 in circles or in any other desired trajectory. The illumination source may be activated by squeezing compartment 120 between two fingers, with one finger against switch 134. Switch 134 may be sensed by feel through fabric forming compartment 120.

It should be noted that mass of the illumination source is sufficient to cause flexible panel 102 to spread away from handle 110 by centrifugal and other inertial forces when the user swings flexible panel 102 via handle 110.

Some venues forbid light sources such as the illumination source. It is still desirable to wave a banner while cheering at an event venue. The banner 100 may therefore omit the the illumination source and substitute therefor a weight integrated into flexible panel 102 proximate second upper corner 114 of flexible panel 102. The weight may comprise a wafer of synthetic material similar to that used as a structural support for the illumination source.

Banner 100 may be provided by the manufacturer or by a retailer with a bag for storage. The bag may be for example a fabric bag having a hem and drawstring (these items are not shown).

Indicia 104 may be made in a color matching a color representative of a sports team or other participant in the event. The storage bag may also be made in a color representative of the sports team or other participant.

It is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A banner for displaying while cheering at an event venue, the banner comprising:

a flexible panel bearing indicia related to a partisan of an event taking place at the event venue, the flexible panel including an opening and an illumination source integrated into the flexible panel; and a handle engageable with the flexible panel by penetrating the opening of the flexible panel, wherein the flexible panel is polygonal and includes corners between adjacent sides, and the opening is proximate one of the corners of the flexible panel;

the flexible panel includes a compartment at one and only one corner of the flexible panel other than that including the opening of the flexible panel, and. the illumination source and. a battery connected to the illumination source are within the compartment.

2. The banner of claim 1, wherein the compartment is stitched closed, and the illumination source is permanently retained within the compartment.

3. The banner of claim 1, wherein the flexible panel is fabricated from. a woven fabric.

4. The banner of claim 3, wherein the hole of the flexible panel comprises a reinforced border.

5. The banner of claim 1, wherein the illumination source is a unitary device combining a battery, a light emitting element, and a switch controlling the light emitting element.

6. The banner of claim 5, wherein the illumination source includes a controller controlling timing of the light emitting element after the switch. has been operated.

7. The banner of claim 1, wherein the light emitting element comprises a light emitting diode.

8. A banner for displaying while cheering at an event venue, the banner comprising:

a flexible panel bearing indicia related to a partisan of an event taking place at the event venue, the flexible panel including an opening and an illumination source integrated into the flexible panel; and a handle engageable with the flexible panel by penetrating the opening of the flexible panel, wherein the handle comprises a shaft terminating in an enlarged head, and a washer slidably engaging the shaft by friction such that the washer can be slid over the shaft after the shaft has been passed through the opening of the flexible panel, thereby entrapping the flexible panel between the enlarged head and the washer.

9. A banner for displaying while cheering at an event venue, the banner comprising:

a polygonal flexible panel bearing indicia related to a partisan of an event taking place at the event venue, the flexible panel including sides, corners between adjacent sides, an opening proximate a first upper corner of the flexible panel, and a weight integrated into the flexible panel proximate a second upper corner of the flexible panel; and a handle engageable with the flexible panel by penetrating the opening of the flexible panel.

10. The banner of claim 9, wherein the flexible panel includes a compartment proximate the second upper corner of the flexible panel, and the weight is contained within the compartment.

11. The banner of claim 10, wherein the compartment is stitched closed, and the weight is permanently retained within the compartment.

12. The banner of claim 9, wherein the handle comprises a shaft terminating in an enlarged head, and a washer slidably engaging the shaft by friction such that the washer can be slid over the shaft after the shaft has been passed through the opening of the flexible panel, thereby entrapping the flexible panel between the enlarged head and the washer.

13. The banner of claim 9, wherein the flexible panel is fabricated from a woven fabric.

14. The banner of claim 13, wherein the hole of the flexible panel comprises a reinforced border.

15. The banner of claim 9, wherein the weight comprises a wafer of synthetic material.

* * * * *